United States Patent [19]

Clarkson

[11] 4,034,544

[45] * July 12, 1977

[54] METHOD AND APPARATUS FOR PRODUCING PLIED YARN AND PRODUCT THEREOF

[75] Inventor: Robert J. Clarkson, Winnsboro, S.C.

[73] Assignee: Uniroyal Inc., New York, N.Y.

[ * ] Notice: The portion of the term of this patent subsequent to June 28, 1991, has been disclaimed.

[21] Appl. No.: 478,542

[22] Filed: June 11, 1974

Related U.S. Application Data

[63] Continuation-in-part of Ser. No. 363,986, May 25, 1973, Pat. No. 3,820,316.

[51] Int. Cl.[2] ..... D02G 1/02

[52] U.S. Cl. ..... 57/34 HS; 57/140 R; 57/157 TS

[58] Field of Search ..... 57/34 HS, 58.3, 157 TS, 57/140 R, 140 BY

[56] References Cited

U.S. PATENT DOCUMENTS

| | | | |
|---|---|---|---|
| 2,881,504 | 4/1959 | Billion | 57/157 TS |
| 3,383,850 | 5/1968 | Ratti | 57/157 TS |
| 3,422,613 | 1/1969 | Bergen, Jr. et al. | 57/34 HS |
| 3,638,410 | 2/1972 | Scherzberg et al. | 57/34 HS |
| 3,668,857 | 6/1972 | Goy et al. | 57/157 TS |
| 3,820,316 | 6/1974 | Clarkson | 57/34 HS |

*Primary Examiner*—John Petrakes
*Attorney, Agent, or Firm*—Steven H. Bazerman

[57] ABSTRACT

A method and apparatus for producing either bulked continuous filament or spun staple yarn in one continuous operation are disclosed. In the method, a first single end of either continuous filament or spun staple yarn is ballooned about and plied with a like second single end of yarn while both are under tension and advancing at a common linear speed. A higher tension is utilized during the plying operation. The plied yarn is then subjected to heat while the tension is relaxed, followed by a cooling and drying stage, to enable the yarn to be twist-set in a bulked condition, with the component single ends substantially free of any twist memory. This abstract is not to be taken either as a complete exposition or as a limitation of the present invention, however, the full nature and extent of the invention being discernible only by reference to and from the entire disclosure.

18 Claims, 3 Drawing Figures

METHOD AND APPARATUS FOR PRODUCING PLIED YARN AND PRODUCT THEREOF

CROSS REFERENCE TO RELATED APPLICATION

This is a continuation in part of application Ser. No. 363,986 filed May 25, 1973 now U.S. Pat. No. 3,820,316.

BACKGROUND OF THE INVENTION

The present invention relates generally to the fabrication of tufting yarn utilized in the manufacture of shag carpeting and the like. More particularly, the present invention relates to a method of and apparatus for producing plied yarn from either continuous filament yarn or from staple yarn in one continuous operation wherein single ends of yarn are plied with one another and twist-set in a bulked condition.

The fabrication of tufting yarn for shag carpeting and the like from either continuous filament or spun staple yarn is conventionally effected by a "batch" process in which single ends of yarn are joined to one another and processed in a number of independent and discontinuous steps. The steps of this process in general are: (a) twisting each single end of yarn about its own longitudinal axis, for example to the extend of 3 turns per inch in the "Z" direction; (b) plying the twisted single ends with one another with an equal amount of twist but in the opposite, i.e. the "S," direction, so that the initial "Z" twist is removed from each of the single ends; (c) skeining the plied yarn by winding the latter on a swift; (d) tumbling the plied yarn in the presence of moist heat, e.g. steam at atmospheric, to develop the inherent bulk in the yarn; (e) twist-setting the plied yarn in an autoclave wherein the yarn is subjected to high-temperature pressurized steam; (f) drying the yarn in the presence of dry heat; and (g) deskeining the yarn and winding it upon a tube.

One of the disadvantages of this batch process is the need for the above-recited numerous and time consuming steps for the yarn after the starting ends have been plied to one another. Moreover, the initial twisting of the single ends of yarn independently of one another before they are plied together leads to another disadvantage. When the pre-twisted single ends are plied to one another, with a ply twist generally equal but opposite in direction to the singles twist, they should lose the previously imparted twist and return to the producer's twist, i.e. a twist of virtually zero. However, since each single end of yarn, after having been given its initial twist, is normally stored for a period of time, often many hours prior to being plied, the single ends develop a memory and a tendency to revert back to the initial twist after the plying operation. Thus, the single ends which form the plied yarn, tend to flare or separate from one another rather than remain in a predictable twist-retentive condition necessary for high quality shag carpeting unless they are twist-set at a high temperature. Such high temperature twist-setting tends to affect the uniform dyeability of the plied yarn.

SUMMARY OF THE INVENTION

Accordingly, it is a primary object of the present invention to provide a novel method of and apparatus for producing either plied, bulked, continuous filament or spun staple yarn in a manner enabling the disadvantages and drawbacks of the known processes and apparatuses of this type to be efficaciously avoided.

It is another object of the present invention to provide such a method which can be carried out in one continuous operation providing a plied yarn having no twist memory when used with continuous filament yarn and a twist memory of no more than ½ twist per inch for spun staple yarn in the component single ends of yarn.

It is still another object of the present invention to optimize the development of bulk and dyeability in the plied yarn by twist-setting the plied yarn in the presence of either dry or moist heat under relaxed tension.

Generally speaking, the objectives of the present invention are achieved through the use of an apparatus in which, in one continuous operation, single ends of either untwisted bulk continuous filament or relatively low twist spun staple yarn on the order of ½ twist per inch are given a false twist and plied to one another by a ballooning of one end about the other while both are advanced under tension and at a common linear velocity to form a twist-retentive plied array, and the resultant plied yarn is then advanced while under relaxed tension first through a heating zone in which the plied yarn is twist-set, and then through a cooling and drying zone preparatory to being wound into a package. Since, in the practice of the present invention, the twist-setting temperature does not have to be high enough to overcome the memory of an initial singles twist, such temperature may be lower than has been the case in the conventional process.

BRIEF DESCRIPTION OF THE DRAWINGS

The above and additional objects and advantages of this invention will be more clearly understood from the following detailed description thereof when read in conjunction with the accompanying drawings, in which.

DETAILED DESCRIPTION OF THE INVENTION

Figure 1:
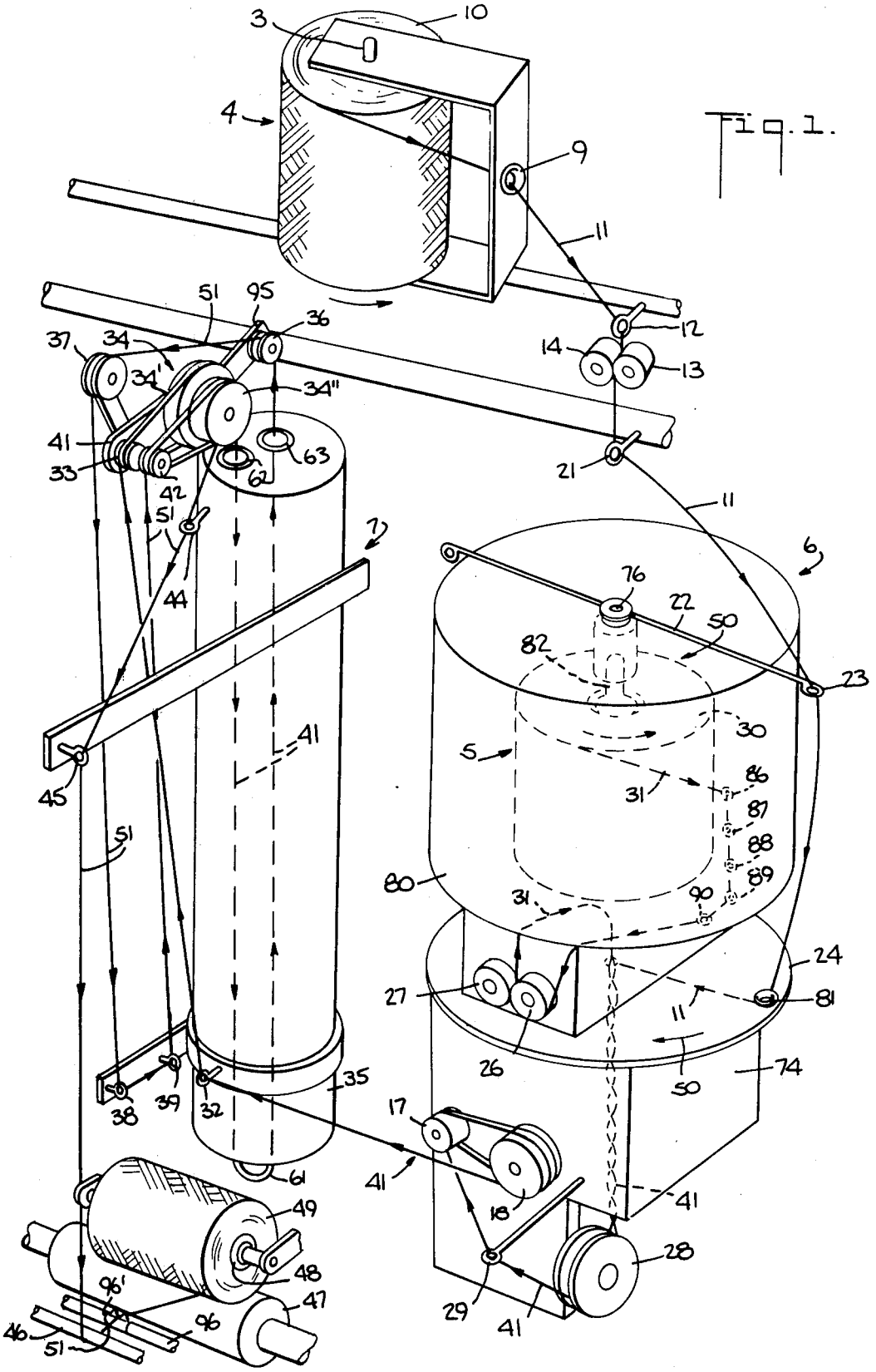
FIG. 1 is a fragmentary schematic view, in perspective, of an apparatus according to a preferred embodiment of the present invention.

Referring now to the drawings in greater detail, the apparatus according to the preferred embodiment of the present invention comprises, in series, a first yarn supply station 4, a second yarn supply station 5, a ballooning station 6 in which the second yarn supply station 5 is disposed, a twist-setting station 7 having both a heating zone and a cooling and drying zone, and a take-up station 8.

The first yarn supply station 4 includes a low friction skewer means 3 for supporting a yarn package 10 from which a single end of yarn 11 is to be drawn for advancement to the ballooning station 6. To guide the yarn 11 along this portion of its movement, there are provided guides 9 and 12 which lead the yarn under very low tension 11 to the nip formed by a driven metering roll 13 and pressure roll 14 which acts to isolate the tension in yarn 11 on one side of the rolls 13 and 14 from the other.

From the nip between rolls 13 and 14, yarn 11 proceeds through pigtail guide 21 to the ballooning station 6. The ballooning station 6 includes a pot 80 which is located above a stationary housing 74 and incorporates a second yarn supply station 5, i.e. the location of a yarn package 30 from which a second single end of yarn 31 to be plied with the yarn 11 can be drawn. Arranged atop the pot 80 is a spindle or stub shaft 76 rotatably supporting a flier 22 provided with a pair of oppositely directed, counterbalancing arms each of which terminates in a respective yarn guide or pigtail 23. The previously mentioned pigtail guide 21 is disposed on the axis of rotation of the flier 22.

Figure 2:
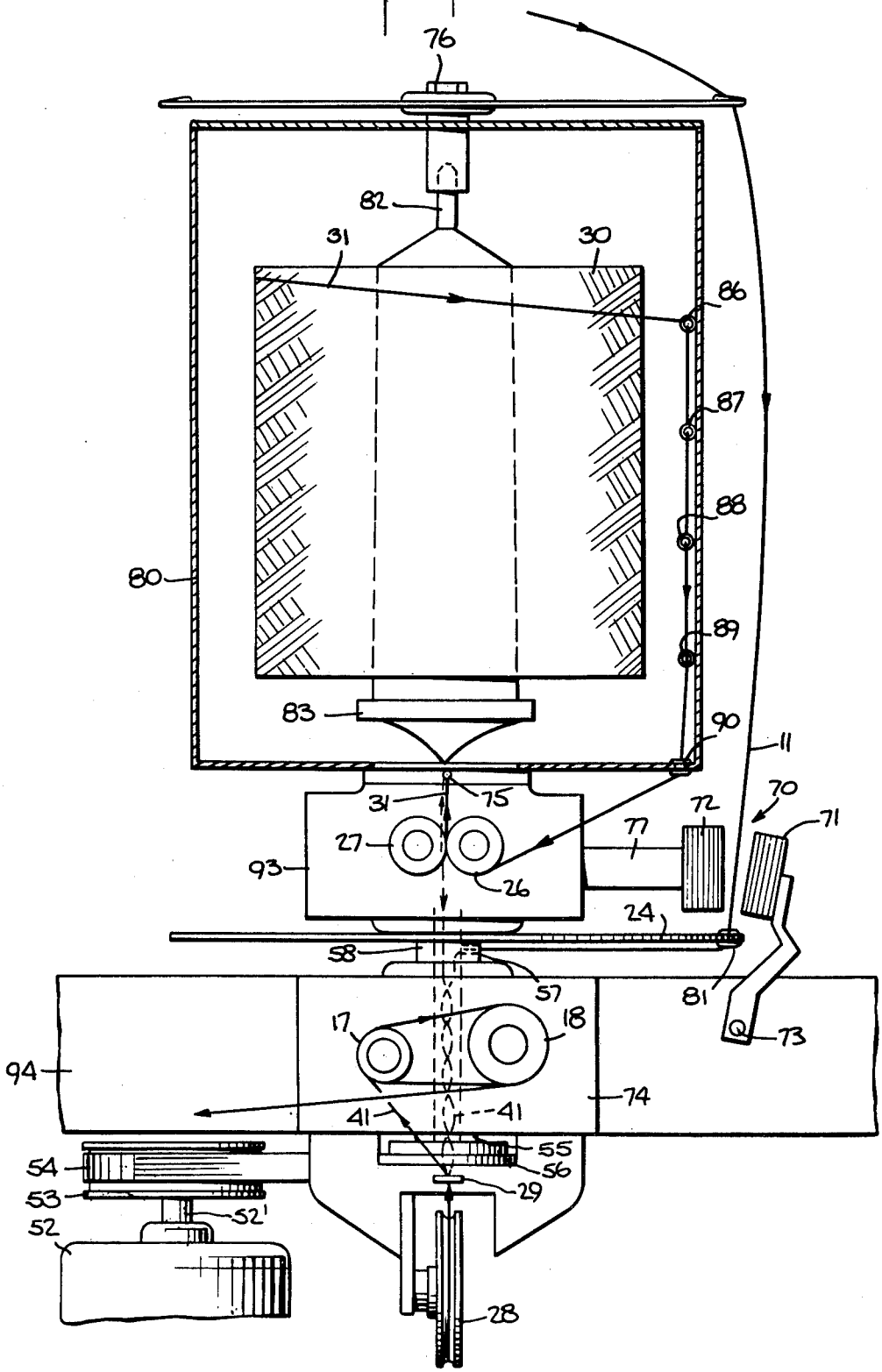
FIG. 2 is an enlarged, fragmentary, elevational view partly in section, of the ballooning portion of the apparatus.

Arranged below the pot 80 is a horizontal rotatable plate 24 which is fixedly secured above the housing 74 to a rotatable hollow shaft or spindle 58 journaled in the housing 74 with the aid of suitable bearings (not shown). The plate 24 is rotated in the direction of arrow 50 by means of a drive assembly (shown in FIG. 2 only) including a motor 52, a first pulley 53 secured to the motor shaft 52′ a second pulley 56 secured to the bottom end of the spindle 58, and a belt 54 drivingly connecting the pulley 53 to the pulley 56. The plate 24 is provided at one point adjacent to its peripheral edge with a yarn guide aperture 81 and the spindle 58 is provided between the plate 24 and the housing 74 with a radially directed passageway 57 (FIG. 2). From the pigtail guide 21, therefore, the yarn 11 passes through the yarn guide 23 of the flier 22 and the guide aperture 81 in the plate 24, into the radial passageway 57 in the spindle 58, and thence into the hollow interior of the spindle 58.

Reverting now to the pot 80, the latter is provided in its interior with a low friction skewer means 82 and 83 for centering and supporting the yarn package 30. The yarn 31, when being drawn off the package 30, runs to an exit aperture 90 from the pot via yarn guides 86 through 89.

As shown in FIG. 2, the pot 80 is supported by a second stationary housing 93 interposed between the plate 23 and the pot 80. For a reason which will become clear presently, a portion of the shaft or spindle 58 extends upwardly beyond the plate 24 and into the housing 93 where that portion of the spindle is also journaled by means of suitable bearings (not shown). Inasmuch as the housing 93 is supported only by the spindle 58, a breaking device 70 (shown in FIG. 2 but omitted from FIG. 1 for the sake of simplicity) is provided to inhibit rotation of the housing 93 and pot 80 with the spindle 58 and plate 24. In the illustrated form of the apparatus, the braking device includes a magnet 71 adjustably mounted at 73 on a beam or like member 94 of the framework supporting the housing 74 and a second magnet 72 mounted on an arm or like adjunct 77 of the housing 93, the magnets being spaced from one another sufficiently to straddle and leave unobstructed the path of movement of the yarn 11 from the flier 22 to the plate 24.

Also mounted on the housing 93 for rotation about parallel axis are the metering roll 26 and pressure roll 27. Roll 26 is rotatably driven by an suitable means (not shown) located in the housing 93, while pressure roll 27 is in an idler roll. The yarn 31 passes between the nip of rolls 26 and 27 which act to draw the yarn 31 at very low tension from yarn package 30 and to isolate the tensions on the yarn 31 on either side of said rolls 26 and 27 from each other. Roll 26 is provided with a high friction slippage-preventing surface, such as by coating of the roll with a material like aluminum oxide. From the pressure roll 27, the path of movement of the yarn 31 goes through a transverse passageway 75 (FIG. 2) disposed at the top of the housing 93 and thence into the top end of the portion of the follow spindle 58 located in the housing 93, toward the entry location 57 of the yarn 11.

Freely rotatably journaled below the housing 74 is a preferably grooved idler roll 28 one side of which is shown as being located tangent to the axis of the spindle 58 and thus to the path of movement of the plied yarn 41 (formed, in a manner to be explained presently, from the ends of yarn 11 and 31).

From the roll 28 the plied yarn 41 is drawn to the treating zone of the twist-setting station 7 via pigtail guides 29 and 32, between which the yarn passes several lines around the pair of rolls 17 and 18.

With respect to the driving of the rolls 13, 18 and 26, it will be understood that this may be achieved in any suitable fashion. Merely by way of example, however, the actual arrangement (not shown) used in the illustrated apparatus includes a pair of sleeve or like annular gears carried by and rotatable with the spindle 58 in the housing 74 and 93, respectively, each such gear constituting a part of a respective gear train the last component of which is in direct driving relation to shaft of the associated roll. Roll 13 is chain driven from the back end of the shaft that carries roll 18.

In the operation of the section of the apparatus so far described, with the starting single ends of yarn 11 and 31 threaded into the apparatus as shown, both yarns are drawn from their respective packages 10 and 30 by means of rolls 13 and 26. When the single ends are formed from low twist spun staple yarn, the yarn is removed from the packages at a low tension of from 0 to 10 grams in order to prevent the single ends from being torn apart. The use of skewers 3, 82 and 83 to mount the yarn packages 10 and 30 acts to allow the use of such low tension. The inherent false twist inserted by the plying operation itself give enough stability to allow the single end 11 to be ballooned around the other end 31 at a higher tension of from five hundred to two thousand grams. This tension must be sufficient to give a stable balloon in the yarn used at the operating speed of the spindle. The pairs of rolls 26 and 27, and 13 and 14 act to allow such increase in tension by isolating the tensions on the respective yarns 11 and 31 as they are drawn from their packages 10 and 30 from the tensions during ballooning and plying. The yarn paths unite at the plying station defined in the upper section of the rotating spindle 58. Since the plate 24 rotates at high speed with the spindle, the continuously advancing portion of the yarn 11 interposed between the guide 21 above the pot 80 and the guide aperture 81 in the plate 24 is revolved and ballooned around both the pot 80 and the second yarn supply station 5. Thus, the yarns 11 and 31 are laid upon one another and formed into a substantially twist-retentive, plied array 41.

The plied yarn 41 is drawn from the ballooning station by the roll 18 at a somewhat higher linear speed than the feed-in rate of the metering rolls 13 and 26. This causes the plied yarn to be subjected to the greater tension during the plying operation than that to which the single ends 11 and 31 are subjected as they leave packages 10 and 30. The purposes of stretching the plied yarn and thereby increasing the tension is primarily to maintain the stability of the balloon.

Figure 3:
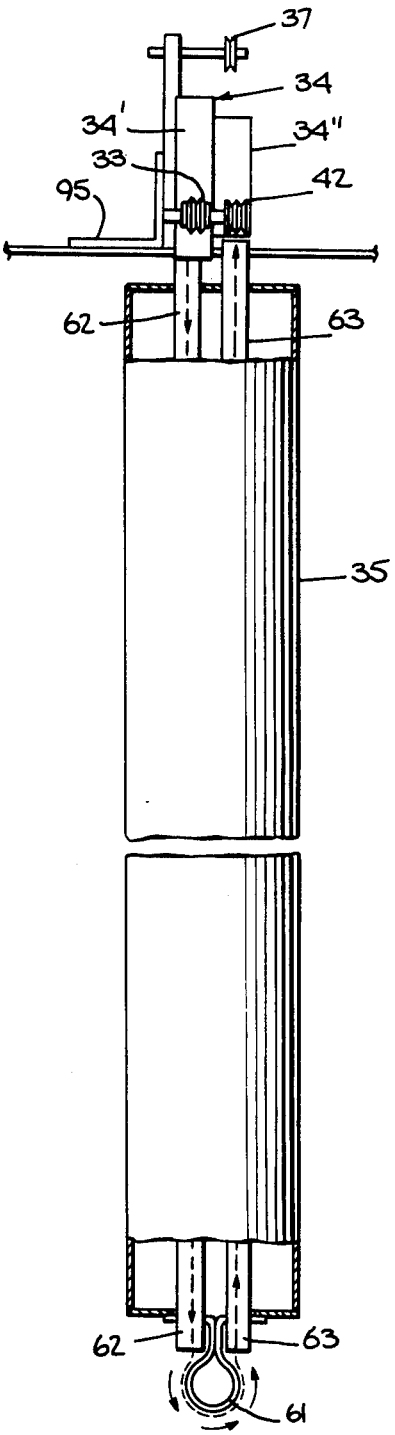
FIG. 3 is an enlarged, fragmentary, elevational view, partly in section, of the heating portion of the apparatus.

Thereafter the plied yarn 41 is continuously heat set. Referring now to FIGS. 1 and 3, the heating zone of the twist-setting station 7 comprises a closed cylindrical jacket 35 in which is fixedly mounted a pair of spaced, open-ended, parallel tubes 62 and 63. The jacket 35 is provided with suitable inlet and drain ports or fittings (not shown) for admission of steam into the jacket and extraction of condensate therefrom. A curved guide plate 61 is fixedly secured to the underside of the jacket 35 in juxtaposition to the botton end openings of the tubes 62 and 63. Adjacent the upper end of the jacket 35 is arranged, on a suitable framework 95, a rotatable idler roll 33, and a further idler roll 34'. The roll 34' is preferably provided with a high friction surface similar to those provided on the rolls 13, 18 and 26.

The drying and cooling zone of the twist-setting station 7 comprises a pair of guide rolls 36 and 37 freely rotatably mounted on the framework 95, and idler roll 42 arranged coaxially with the roll 33, another idler roll 34'' arranged coaxially with but having a somewhat smaller diameter than the roll 34' and a plurality of yarn or pigtail guides 38 and 39. The roll 42 is rotatable independently of the roll 33. The roll 34'', however, is integral and thus jointly rotatable with the relatively larger diameter roll 34' and, like the latter, has a high friction surface. In practice, the rolls 34' and 34'' are different diameter sections of a single roll generally designated 34.

The winding or take-up station 8 includes, among other items not necessary to illustrate or describe herein, a guide bar 46 to which the yarn path from the roll 34'' is defined by a pair of pigtail guides 44 and 45, a longitudinally reciprocally movable transversing rod 96 carrying a yarn guide 96'', and a power driven roll 47, to enable the twist-set plied yarn, here denoted 51, to be properly wound onto a suitable core or tube 48 into the form of a package 49.

In operation, the plied yarn 41 emanating from the ballooning station 6 passes via pigtail guide 32 to and over the laterally aligned idler rolls 33 and 34' and moves thence downwardly into and through the heating tube 62. Upon emerging from the open bottom end of the tube 62, the yarn 41 passes over and around the guide plate 61 and then enters and moves upwardly through the second heating tube 63. The plied yarn 41 thus makes a double pass through the heating zone in which the twist-setting temperature is maintained preferably just below the softening or "sticking" point of the yarn material. The arrangement may be such that the yarn 41 will be subjected to dry heat, in which case the steam is not permitted to come in contact with the yarn, or that the yarn will be subjected to moist heat, in which case the steam will be permitted to come in contact with the yarn. The twist-set plied yarn 51 emerging from the tube 63 then passes over the guide rolls 36 and 37 and thence via the pigtail guides 38 and 39 to and over the laterally aligned rolls 42 and 34'', being cooled and, if necessary, dried during this interval. From the roll 34'', the yarn 51 then moves to the guide bar 46 at the winding or take-up station 8.

It will be understood that the portion of the yarn 51 moving from the roll 34'' to the guide bar 46 is under tension, and that by virtue of the frictional engagement between the roll 34'' and the yarn 51, the pull of the winding mechanism effects the rotation of the roll 34'' and therewith of the roll 34'. Concomitantly, by virtue of the frictional engagement between the roll 34' and the yarn 41, the rotation of that roll effects the movement of the yarn 41 from the rolls 17 and 18 toward the heating tube 62. As previously stated, however, the diameter of the roll 34'' is somewhat smaller than that of the roll 34'. The linear peripheral speed of the yarn 51 passing over the roll 34'' thus is less than the linear peripheral speed of the yarn 41 passing over the roll section 34'. As a result, the tension on the plied yarn advancing through the heating and cooling zones of the twist-setting station 7 is relaxed, preferably to a point at which the tension approaches, or is virtually, zero but nevertheless is just sufficient to prevent any substantial slackening and accumulation of yarn either within the tubes 62 and 63 or along the subsequent path up to the roll 34''. The plied yarn is, therefore, permitted to contract or shrink longitudinally somewhat while it is being twist-set in the heating zone and then cooled and dried, which enhances the degree of bulk in the final plied yarn 51 as well as its capacity to retain its twist and bulk. The two-section roll 34 may, therefore, be characterized as a shrink roll assembly.

The arrangement according to the present invention thus can be seen to provide a number of advantages in addition to those already set forth herein. For example, since the yarn 51 is substantially dry before it reaches and is wound into the package 49, it does not have to be subjected to those further processing stages, such as skeining, tumbling, heating, prolonged drying, and deskeining operations, which would normally be required in conventional processing of tufting yarns. Moreover, since the yarn has become fully stabilized in its twist-set state by the time it reaches the roll 34'', the yarn 51 moving from that roll to the winding station 8 can be subjected to the higher winding tension without risk of damaging the inherent bulk of the twist-set plied yarn. The provision of the shrink roll assembly 34 at the same time ensures that the portion of the yarn moving from the roll 34' through the heating and cooling drying zones to the roll 34'' remains isolated from such high tension which, if applied to the yarn during this stage, would kill or destroy the inherent bulk.

It will be understood that the foregoing description of a preferred embodiment of the present invention is for purposes of illustration only, and that the various structural and operational features and relationships herein disclosed are suscepticle to a number of modifications and changes none of which entails any departure from the spirit and scope of the present invention as defined in the hereto appended claims.

What is claimed is:

1. A method of producing plied spun staple yarn, said method comprising, in one continuous operation, the steps of:

a. drawing first and second spun staple yarns, at equal linear speeds and under low tension from respective yarn suplies;

b. isolating the first and second yarns so that the tensions on the yarns during plying are not transmitted to the yarns as they are removed from said yarn supplies;

c. plying said yarns to one another at a plying station by ballooning one of said yarns around the other while placing a false twist on each of said yarns;

d. drawing said plied yarn away from said plying station at a linear speed a predetermined amount greater than said first and second yarns are removed from their respective yarn supplies; thus subjecting said plied yarn to a tension much greater than the tension on said first and second yarns as they are removed from their respective yarn supplies.

2. The method of claim 1 wherein the first and second yarns are drawn from said yarn supplies at a tension of less than 10 grams.

3. The method of claim 1 wherein the plied yarns are drawn away from said plying point at a tension of between 500 to 2000 grams.

4. The method of claim 1 wherein the following further steps are performed continuously therewith:

e. isolating the plied yarn so that the tension on the plied yarn as it is drawn from said plying point is not transmitted to said plied yarn during the twist-setting of said plied yarn;

f. drawing said yarn after under a tension substantially lower then the tension that is is drawn from said plying point first through a heating zone and then through a cooling and drying zone for twist-setting said plied yarn and enhancing its capacity to retain its resultant twist and bulk; and g. drawing said twist-set plied yarn under increased tension from said cooling and drying zone to a take-up station for winding said twist-set plied yarn into a package.

5. A method as claimed in claim 4, wherein said plied yarn leaving said plying station is fed into said heating zone at a linear speed greater than the speed at which said twist-set plied yarn is drawn through said cooling and drying zone.

6. A method as claimed in claim 5, wherein said linear feed speed of said plied yarn into said heating zone and said linear feed speed of said twist-set plied yarn away from said cooling and drying zone are predetermined to insure that the tension on said plied yarn during the twist-setting thereof and on said twist-set plied yarn during the cooling and drying thereof is relaxed to virtually zero, yet is sufficient to prevent any substantial yarn slackening and accumulation in said zones.

7. A method as claimed in claim 6, wherein said plied yarn is subjected to moist heat in said heating zone.

8. A method as claimed in claim 6, wherein said plied yarn is subjected to substantially dry heat in said heating zone.

9. A method as claimed in claim 6, wherein the length of the path of movement of said twist-set plied yarn through said cooling and drying zone is sufficiently long to effort both the required cooling of said twist-set plied yarn and the evaporation from the same of any moisture picked up by said plied yarn while in said heating zone.

10. A plied, spun staple yarn produced by the method of claim 4 and having substantially no pretwist memory in the component single ends of yarn after the plying thereof.

11. Apparatus for producing plied spun staple or filament yarn is one continuous operation, said apparatus comprising:

a. separate means for drawing a first and second single ends of yarn, at equal linear speeds and under low tensions from respective yarn supplies and isolating the tensions in said first and second yarns as they are drawn from said yarn supplies from the tensions in the yarn after each has left its respective drawing means;

b. means for plying said yarns to one another at a plying station by ballooning said first yarn around the second while placing a false twist on each of said yarns;

c. means for drawing said plied yarn away from said plying station at a linear speed a predetermined amount greater than that said first and second yarns are drawn from their respective supplied for subjecting said plied yarn to a much greater tension than the tension on each of said first and second yarns as they are drawn from their yarn supplies.

12. The apparatus of claim 11, further comprise:

d. respective means defining a heating zone and a cooling and drying zone for passage of said plied yarn therethrough while being twist-set;

e. means for drawing said plied yarn from said plying station through said heating zone and said cooling and drying zone and for concurrently relaxing the tension on said plied yarn, for twist-setting said plied yarn and enhancing its capacity to retain its resultant twist and bulk; and f. means for drawing said twist-set plied yarn under increased tension from said cooling and drying zone to take-up station for winding said twist-set plied yarn into a package.

13. Apparatus as claimed in claim 12, wherein said separate named means for drawing the first and second yarns from these respective yarns supplies each comprised of a metering roll and a pressure roll in contact with each other and between which the respective first and second yarn pass, each of said metering rolls having a high friction peripheral surface for slip-free engagement with the respective one of said first and second yarns, and means operatively connected with said metering rolls for driving the same at equal rotational speeds.

14. Apparatus as claimed in claim 13, wherein said plied yarn drawing means comprises a third roll having a diameter greater than the diameter of each of said metering rolls and adapted to have said plied yarn passed at least partially thereabout subsequent to said plied yarn leaving said plying station, said third roll having a high friction peripheral surface for slip-free engagement with said plied yarn, and means operatively connected with said third roll for driving the same at the same rotational speed as said metering rolls.

15. Apparatus as claimed in claim 14, wherein said third-named drawing means comprise fourth and fifth rolls the diameter of the former of which is greater than that of the latter, said fourth roll being adapted to have said plied yarn leaving said third roll passed at least partly thereabout prior to entry of said plied yarn into said thereabout prior to entry of said plied yarn into said heating zone, said fifth roll being adapted to have said twist-set plied yarn passed at least partly thereabout upon said twist-set plied yarn leaving said cooling and drying zone, each of said fourth and fifth rolls having a high friction peripheral surface for slip-free engagement with said plied yarn and said twist-set plied yarn, respectively, and said fourth and fifth rolls being adapted to rotate at equal rotational speeds.

16. Apparatus as claimed in claim 15, wherein said fourth and fifth rolls are respective different diameter sections of a unitary idler roll structure, and said fourth-named drawing means comprises power-driven take-up means, the rotational speed of said unitary idler roll structure being determined by the linear speed of movement of said twist-set plied yarn engaging said fifth roll.

17. Apparatus as claimed in claim 11 wherein the means for drawing the first yarn from its yarn supply comprises a metering roll and a pressure roll in contact with each other and between which said first yarn passes, and wherein said drawing means is positioned between the yarn supply of said first yarn and the means for plying said yarn, in close proximity to the supply means for said first yarn.

18. Apparatus as in claim 11 wherein the yarn supplies are mounted on low friction skewer means which permit the removal of yarn at low tension

* * * * *

UNITED STATES PATENT AND TRADEMARK OFFICE

CERTIFICATE OF CORRECTION

PATENT NO. : 4,034,544

DATED : July 12, 1977

INVENTOR(S) : ROBERT J. CLARKSON

It is certified that error appears in the above-identified patent and that said Letters Patent are hereby corrected as shown below:

Col. 6, Claim 1, par. a, line 53 correct the spelling of "suplies" to --supplies--

Col. 7, Claim 4, par. f, line 14 correct the spelling of "then" to --than-- and the word "is" first occurrence should read --it--

Col. 7, Claim 9, line 46, correct the spelling of "effort" to --effect--

Col. 8, Claim 11, par. c, line 4, correct the word "supplied" to read --supplies--

Col. 8, Claim 13, line 24, the word "yarns" should read --yarn--

Col. 8, Claim 15, line 45, the word "comprise" should read --comprises--; and, line 50, delete the following [ said thereabout prior to entry of said plied yarn into ]

Col. 10, Claim 18, line 5, after "tension" add --.--

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*